United States Patent [19]

Gemsjäger

[11] Patent Number: 5,031,845

[45] Date of Patent: Jul. 16, 1991

[54] METHOD AND DEVICE FOR THE GRINDING AND SEPARATING OF GRAIN

[75] Inventor: Helmut Gemsjäger, Brunswick, Fed. Rep. of Germany

[73] Assignee: Bühler GmbH, Brunswick, Fed. Rep. of Germany

[21] Appl. No.: 438,422

[22] PCT Filed: Mar. 3, 1989

[86] PCT No.: PCT/EP89/00221

§ 371 Date: Nov. 13, 1989

§ 102(e) Date: Nov. 13, 1989

[87] PCT Pub. No.: WO89/08501

PCT Pub. Date: Sep. 21, 1989

[30] Foreign Application Priority Data

| | | | |
|---|---|---|---|
| Mar. 10, 1988 | [DE] | Fed. Rep. of Germany | 3807843 |
| Apr. 12, 1988 | [DE] | Fed. Rep. of Germany | 3812056 |
| Jan. 20, 1989 | [CH] | Switzerland | 176/89 |

[51] Int. Cl.[5] ..... B02C 4/06

[52] U.S. Cl. ..... 241/78; 241/13; 241/159; 241/232

[58] Field of Search ..... 241/6-13, 241/76, 77, 78, 80, 97, 135, 143, 159, 29, 32, 101.2, 230, 234, 231, 232

[56] References Cited

U.S. PATENT DOCUMENTS

| | | | |
|---|---|---|---|
| 453,364 | 6/1891 | Taylor | 241/11 X |
| 3,027,101 | 3/1962 | Szasz . | |
| 3,419,223 | 12/1968 | Morin | 241/285 B X |
| 4,043,514 | 8/1977 | Peterson | 241/258 B X |
| 4,198,005 | 4/1980 | Eiff | 241/285 B X |
| 4,220,287 | 9/1980 | Boczewski | 241/13 X |

FOREIGN PATENT DOCUMENTS

| | | | |
|---|---|---|---|
| 236485 | 11/1909 | Fed. Rep. of Germany . | |
| 709957 | 7/1941 | Fed. Rep. of Germany . | |
| 2358195 | 2/1978 | France . | |
| WO89/03247 | 4/1989 | PCT Int'l Appl. | 241/13 |
| 407316 | 3/1934 | United Kingdom . | |
| 529518 | 11/1940 | United Kingdom | 241/11 |
| 2029264 | 3/1980 | United Kingdom . | |

OTHER PUBLICATIONS

Sechswalzen Hochleistungs Malzschrotmuhle Publication, 9-84.

*Primary Examiner*—Mark Roenbaum
*Attorney, Agent, or Firm*—Martin A. Farber

[57] ABSTRACT

A device for grinding and separating grains, in particular for grinding malt, consisting of at least two roll packages (4, 5, 6) in the form of, with respect to their forces, self-contained units arranged vertically above each other on load-bearing columns (2) of a machine housing (3), and of a pair of screen units (7, 8) oscillating above the lowermost roll package (6) in opposite direction in a horizontal plane and thus with little vibration with respect to the overall device. The screen units are articulated on the machine housing (3) by relatively short levers (27', 29, 31', 33) into which the drive forces for the vibratory equipment are introduced from the center of the machine in such a manner that all rotating parts of the drive (9) are located outside the dusty screen space. In order to increase the screen surface, the screen units (7, 8) are each provided with two continuously inclined screen compartments (10 to 13) equipped with screen frames, all screen frames (14, 14', 15, 15') of a screen unit (7, 8) being firmly clamped on all sides or released for the pulling out thereof by the actuation of a single closure flap.

57 Claims, 11 Drawing Sheets

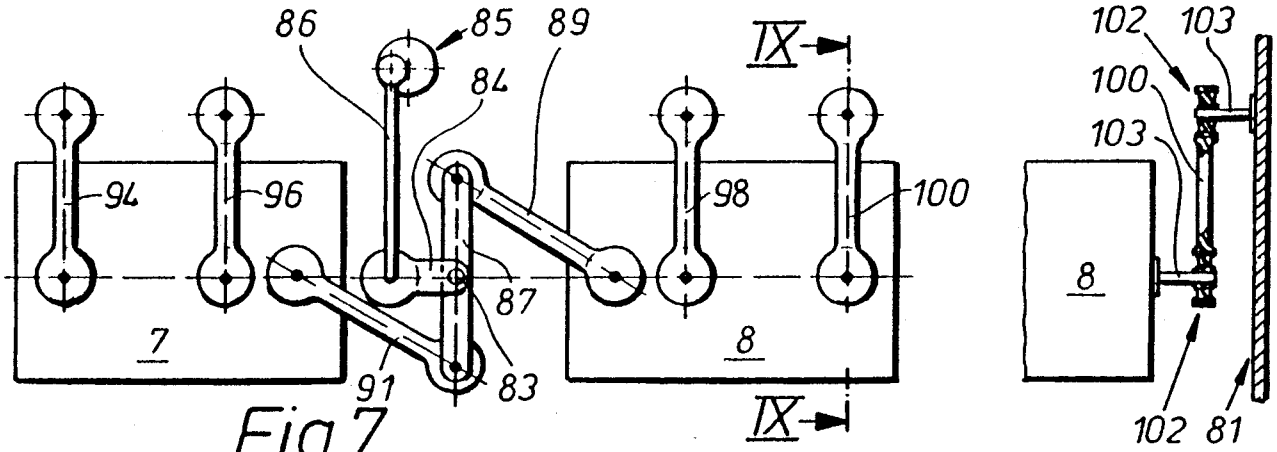
Fig. 9
Fig. 7
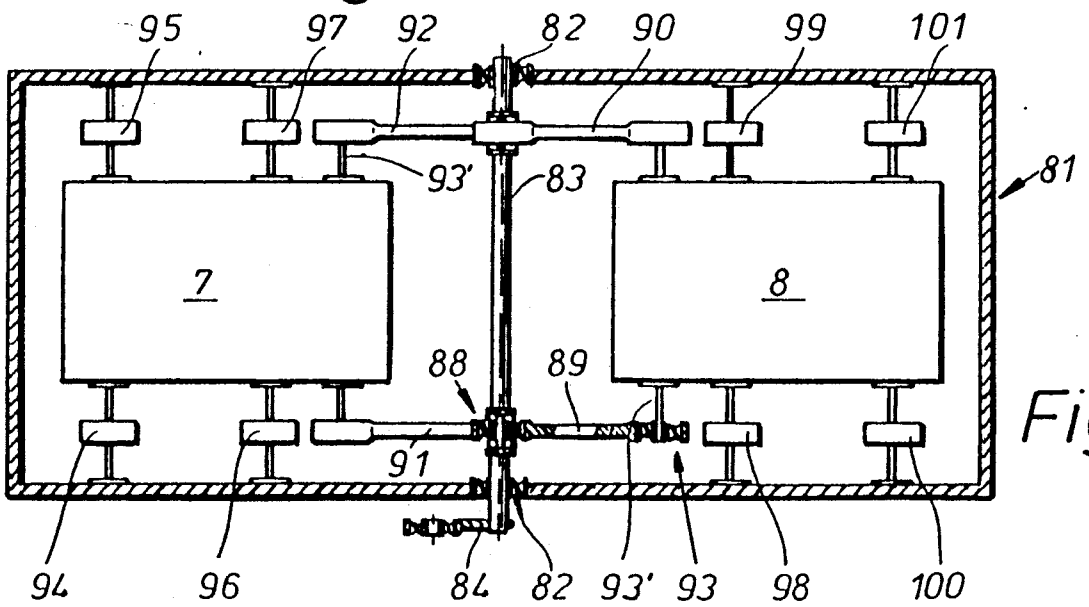
Fig. 8

METHOD AND DEVICE FOR THE GRINDING AND SEPARATING OF GRAIN

FIELD AND BACKGROUND OF THE INVENTION

The present invention relates to a method and device for grinding and separating grain.

A device of this type having two pairs of rolls can be noted from Federal Republic of Germany Patent 709 957. However, the throughput does not remotely satisfy present-day requirements, due to the relatively small screen surface available. There is also the additional factor that the degree of grinding in a mill with only two pairs of rolls can satisfy only modest requirements.

In the past therefore, so-called six-roll mills were predominantly developed and built for the crushing of malt the basic construction of which is known, for instance from Republic of Germany Patent 236 485 and U.S. Pat. No. 4,225,093. These mills are characterized essentially by three pairs of rolls arranged in a triangular configuration and two, mostly multilayer, screen devices, the upper one of which covers approximately the region from below the first pair of rolls to above the second pair or rolls and the lower of which covers approximately the region from below the second to above the last pair of rolls. In most cases, the first and the last pairs of rolls are arranged approximately vertically above each other, while the middle pair of rolls is located on an intermediate plane and laterally staggered by approximately the length of the screen devices.

In this machine design, the output of the mill, which depends generally on the length of the rolls and the size of the screen surface, is determined essentially by the size of the lower screen device over which about 90% of the total amount of product must be moved, while only about 10% of the flour and grits are separated out by the upper screen device and need no longer be passed through the two remaining roll passes.

The screen devices are, as a rule, vibrating screens which are suspended or supported for oscillation and are driven via long connecting rods by an eccentric shaft mounted approximately at the height of the center pair of rolls on the opposite side of the machine housing or even outside the latter. Aside from the uneven loading of the floor caused by the concentration of two pairs of rolls, the eccentric drive and the correspondingly voluminous portion of the housing on one side of the machine, which is undesirable in itself, a reversing moment is produced around the center of gravity of the machine due to the opposing motion of the two vibrating screens at different heights, it being possible for said reversing moment even to be of different size in the event of non-uniformity of the weights of both screens caused, for instance, by product influences. This leads to considerable vibrations of the entire machine, the transmission of which to the base surface can at best be alleviated but not eliminated by suitable vibration insulators such as, for instance, rubber-metal elements. Rather, the machine constantly carries out pitching motions due to the resilience of said vibration insulators which is necessary for their action, so that, for instance, the stationary inlets and outlets for the material can only be connected via flexible elements, such as bellows, etc., to the corresponding feed or discharge devices of the machine. Such vibration insulators and bellows increase the structural expense and result in disadvantages in the important sphere of sanitation; furthermore, they are subject to wear, which is naturally undesirable.

SUMMARY OF THE INVENTION

The present invention is intended to simplify the previous method and to create a device which is characterized by substantially vibration-free operation and uniform loading of the floor, while being economical in construction. At the same time, the proven principle of pairs of rolls having self-contained forces and which therefore do not introduce any forces resulting from the grinding process into the machine housing, is to be retained and the prerequisites are to be created for a substantial increase in the effective screen surface and thus for an increase in performance.

This object is achieved in accordance with the invention by the fact that the grain is ground in two successive steps a first time and then a second time, that the grain which has been ground twice is screened in a third step, and that only the screening residue is ground in a fourth step; and furthermore by at least one pair or rolls arranged in a machine housing and at least one screening device for separating the grain fractions.

As compared with the prior art, the teaching of the present invention results in the advantage of an absolutely symmetrical construction of the machine with inertia forces which neutralize each other and with maximum elimination of the vertical oscillation components of the screen units. Furthermore, the clear arrangement of the machine's structure assures good access to the pairs of rolls and screen units, the double arrangement of which makes an increase in the screen surface possible.

Advantageous further developments of the invention are as follows.

One feature of the invention makes it possible to achieve almost a doubling of the effective screen surface as compared with the prior art, with almost no change in the base area of the machine.

A practicably negligible vertical oscillation component of the screen units or screen compartments, can in no way be compared to the prior-art machines.

Features of the invention assure, in particular, easy access to and locking of the screen frames in the direction of screening and perpendicular thereto, without special screw connections or other time-consuming manipulations, due to the fact that all functions are assured solely by actuating the closure flap.

The conducting away of the electrostatic charge of the screen fabric and of the so-called ball bottoms of the screen frames which is required for explosion protection is assured, in simple but effective manner.

Also included is a drive concept for the screen units which has numerous advantageous and yet simple and economical details.

The invention contributes substantially both to the freedom from vibration and to the simplicity and low-maintenance requirements of the device of the invention in the manner that the arrangement of the eccentric and of the connecting rods outside the machine housing proper makes the traditional, separate eccentric shaft space and the sealing off thereof from the dusty inside of the mill superfluous. In this way, the customary bellows or collars as sealing elements which surround the upward and downward moving connecting rods and which are subject to wear are eliminated, as well as the troublesome assembly and adjustment work on the connecting rods necessary upon their replacement.

A further feature assures a simple and economical possibility of adjustment for the eccentric. Other advantages reside in the elimination of the substantially more expensive self-aligning roll bearings and their bearing housings, which are usually standard in such screen drives. This simplification is made possible by the relatively short connecting rods and the clearly defined drive shaft mounting in a pipe traverse in accordance with yet another feature, which results in the further advantage that it simultaneously effects a sealing off of the drive shaft and its bearings from the dust-filled screen space.

If one proceeds from the fact that the eccentric disks and connecting rods are located outside of the machine housing while the screen units which are to be driven are located inside the usually dusty inner space of the machine housing, namely the screen space, then other features of the invention result in a transmission of the drive forces which is as simple as it is economical and which acts at the same time as seal and provides a restoring moment into the central position.

To the extent that, due to the elasticity of the rubber spring elements used, a moment around a vertical axis should be produced, resulting in a certain yielding of the axis of rotation, this effect is advantageously counteracted by the invention.

An alternative drive concept for the screen units which also has economical and simple details is also disclosed.

It is very advantageous and inexpensive that no rotating parts such as drive shaft, eccentric and anti-friction bearings or transmission elements which pass through the housing wall are required for the actual transmission of the drive forces.

In an embodiment according to a further feature, the rolls are relatively easily accessible for replacement. The attachment points can be located to facilitate the installation and removal of the roll in the manner that only the removable bearing halves need be removed in order to be able to remove the rolls from the bearing housings. This is the case, in particular, when the vertically extending part of the machine stand is formed of by two vertical columns to which the bearing housing of the fixed roll is attached at the attachment points and the columns are located between the stub shafts at the roll ends. In this embodiment, installation and removal of the rolls can be effected within wide limits horizontally since no machine parts block access to the roll bearings and there is thus sufficient free space for such replacement work.

With several pairs of rolls fastened to the columns in vertical direction, the result is not only a uniform static stressing of the column but also a uniformly distributed introduction of the moments of the roll drive, without the replacement of the rolls being thereby made more difficult.

In a further embodiment of the invention, the forces to be supplied by the machine stand in order to compensate for the moments introduced by the drive are relatively small and can be made smaller to the extent that the distance between the attachment points is increased.

As can be noted, for instance, from the pertinent company publication, "Six Roll High-Performance Malt Crushing Mill Type DBZA" of the Applicant from the year 1976, mills of the type used in the invention are provided with a number of large-area flaps or doors which are swingably articulated on the machine housing and through which the inside of the mill, in particular the rolls and screens, are accessible for inspection, cleaning and repair. There are concerned here access doors which are generally customary in the construction of machines and apparatus for similar purposes, which doors are articulated on hinges and can be locked at the edge opposite the hinges by means of turnable lever locks available on the market. In most cases, only one such lock is provided; in exceptional cases however, such as in the case of particularly large-area doors, two such locks are occasionally used, which locks must as a rule be operated individually, and one after the other. In some cases—for instance when unauthorized opening of the doors is to be prevented for security reasons—closures or corresponding screw connections which must be actuated by a special socket wrench are also used.

In devices in which finely granular solids can form explosive mixtures with air and can lead to so-called dust explosions, it is desirable to control such events, which cannot be excluded in actual practice despite all efforts to avoid sources of ignition. For this purpose, the protective principle of pressure relief has already been employed, in accordance with which the explosion pressure is so limited with ejection of unburned mixture and combustion gases by the release of predetermined openings that the machine itself is not destroyed. Therefore the exposure itself is not prevented but only its dangerous effects. However, the predetermined openings, developed, for instance, in the form of bursting panes or explosion flaps, must be of considerable size in view of the not inconsiderable volume of the workspace of malt crushing mills if the pressure relief is to be actually effective, i.e. if the mill itself and thus also its maintenance or cover flaps surrounding the workspace are not to be damaged. There is the additional factor that, with respect to the safety of the operating personnel, the pressure relief must not take place directly into the workspace but into the open air, for which discharge pipes are required. The latter considerably restrict the freedom of choice as to the place of installation of the machines or require a large amount of space—if, for instance, due to other technical requirements, the installation of the machine cannot take place in the immediate vicinity of an outer wall of the building—which space is basically not available in the workspace or could be utilized better in some other manner. Such discharge pipes even become a definite obstacle if the place of installation of the machine is relatively far away from an outer wall and the pipes must have a correspondingly larger diameter in order to perform their function.

The invention therefore has the additional object of replacing the protective principle of pressure relief, which has the disadvantages described above, by the principle of so-called pressure-surge resistance, i.e. by a construction which withstands the pressure surge occurring upon an explosion, up to a certain level, without the machine bursting and thus constituting a danger to the personnel, although permanent deformations of the machine may have to be tolerated. There is to be achieved, in particular, here a pressure-surge resistant development of the access flaps or doors with, at the same time, a simple possibility of actuation and without it being necessary to make these flaps or doors themselves unnecessarily heavy or rugged.

Aspects of the invention in the region of the flaps or hoods lead to an introduction of the compressive forces of the explosion into the machine housing which is distributed over the entire edge of the flaps or hoods, it being possible to select the number of articulation elements and locking elements essentially freely and of such a size that the maximum forces devolving upon the individual articulation or locking points remain readily controllable. Despite the large number of locking elements to be actuated, the teaching of the invention discloses, in addition, a way of practical operation by means of a single movement of the hand. It is understood that, in principle, the locking elements associated both with the flaps or hoods and with the housing openings can be made movable, while the corresponding other type of these elements is preferably stationary.

A further feature result can, in particular, be achieved that in the case of an explosion each articulation or locking element must absorb approximately the same pressure forces, which leads to an equalizing of the stresses on all sides.

A very practical development of the individual locking points, in which connection the moveable locking elements are advisedly arranged in the form of bolts within the machine housing where the space conditions are more favorable for accommodating the mechanism required for the mobility, while simultaneously relieving the flaps or hoods from the weight of such mechanism.

There is provided a particularly reliable locking which operates with a relatively high proportion of load-bearing surface elements, the flat shape of the bolts in combination with the development of the hooks as double hooks further reinforcing this characteristic with respect to the edge regions of the openings of the machine housing with, at the same time, a space-saving type of construction.

Also there is provided a suitable embodiment of the activating of all locking elements or of the movement of all bolts by a single movement of the hand, locking in the locking position being also provided.

BRIEF DESCRIPTION OF THE DRAWINGS

One embodiment of the invention together with a variant for the drive of the screen units is shown in the drawings and will be described in greater detail below. In the drawing.

FIG. 7 is a diagrammatic front view of a variant of the drive mechanism for the screen units;

FIG. 8 is a partially cut-away top view of the drive mechanism of FIG. 7 within the stylized machine housing;

FIG. 9 is a linking lever in accordance with the section IX—IX of FIG. 7;

DETAILED DESCRIPTION OF THE PREFERRED EMBODIMENTS

Figure 1:
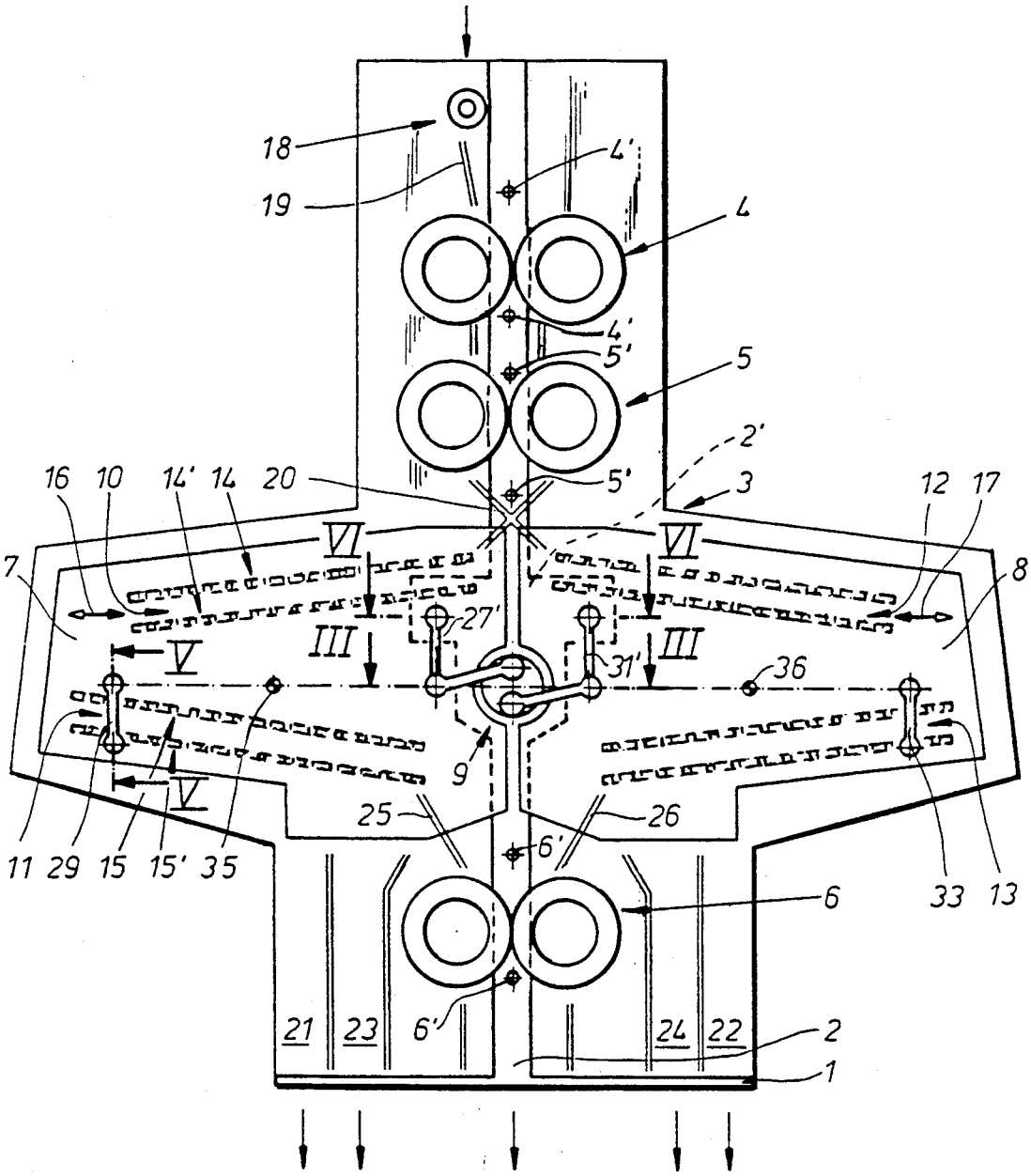
FIG. 1 is a diagrammatic sectional view of the device in accordance with the invention, in the form of a malt crushing mill.

The malt crushing mill shown in FIG. 1 consists essentially of two supporting columns 2 of the machine housing 3 which extend upward from a base plate 1 and between which three roll packages 4, 5, and 6, developed as self-contained units, are attached by indicated screw attachments 4', 5', 6' (see also FIG. 2), and of two screen units 7, 8 which are arranged between the second roll package 5 and the lowermost roll package 6 and have an oppositely directed drive 9.

The screen units 7, 8 are developed symmetrically and have in each case two inclined, double-bottom screen compartments 10, 11, 12, 13, the latter containing in each case two screen frames 14, 14' and 15, 15'. Each screen unit 7, 8 is linked in the region of its lateral walls by means of a total of four linking levers to load bearing parts of the machine housing 3 so that—activated by the drive 9—they can swing back and forth in the direction indicated by the arrows 16, 17 and thereby carry out screening or separating work.

In operation, the material to be ground is fed via a feed roll 18 and guide plate 19 to the roll package 4 where it is ground, as also in the subsequent roll package 5. By a distribution device 20, the grist is uniformly distributed over the two screen units 7 and 8 or their screening compartments 10 and 12, respectively, where the grist and flour portions are already screened off while the husks remain above the screen surface (see also FIG. 10). This process is continued in the lower screen compartments 11 and 13, whereupon flour is finally drawn off through the discharge chutes 21 and 22 and husks through the chutes 23 and 24. Via guide devices 25, 26 the grists pass onto the lowermost roll package 6 where they are also ground into flour.

The arrangement of the screen units is, in this case, such that the screen unit 7 is, on the one hand, arranged suspended on two identical linking levers 27, 28 (FIG. 3, 4) which, in their turn, are finally connected to a corresponding drive lever 27', 28' and swingably mounted in a widened region 2' of the columns 2 of the machine housing 3; on the other hand, the screen unit is swingably supported (FIG. 5) by means of two additional linking levers 29, 30 with respect, for instance, to supporting arms (not shown) extending from the widened region 2' of the columns 2. The linking of the screen unit 8 is developed analogously, i.e. with corresponding linking levers 31, 32 and, associated with the latter, drive levers 31', 32' and "standing" linking levers 33, 34.

In each of the screen units 7, 8, its center of gravity is approximately equally far away from all its linking points and in a plane with the latter (FIG. 1, 3), namely the center of gravity at 35 of the screen unit 7 with respect to the lower linking points of the levers 27, 28 and the upper linking points of the levers 29, 30 and the center of gravity 36 of the screen unit 8 with respect to the lower linking points of the levers 31, 32 and the upper linking points of the levers 33, 34. Due to their mounting in rubber spring elements, which will be described below, all these levers have restoring forces which, in position of rest, i.e. when the drive 9 is not connected, result in a vertical position of all levers. The deflection toward both sides out of this position of rest is relatively slight due to the design of the drive 9 or the oppositely directed vibratory movement produced by it; combined with the also small active lengths of all linking levers, which preferably amounts to only about eight to ten times the swinging distance of these screen units, this leads to a practically horizontal vibratory movement of the screen units 7 and 8, so that practically no disturbing vertical forces at all occur.

The drive 9 which produces the vibratory movement of the screen units 7, 8 consists essentially of a drive shaft 37 which is provided at its two ends with, in each case, two eccentrics 38, 39 and 40, 41, respectively, which act via connecting rods 42, 43 and 44, 45 on the drive levers 27', 28' and 31', 32'. In this case, the eccentrics are in each case arranged staggered in pairs by 180° with respect to each other on drive shaft 37 in such a manner that the eccentrics 38, 39 act on the connecting rods 42, 43 for moving the screen unit 7 and the eccentrics 40, 41 and place the screen unit 8 in motion by means of the connecting rods 44, 45, so that the two screen units 7, 8 carry out oppositely directed vibratory movements.

The connecting rods 42, 43, 44 and 45 are provided with fork-shaped ends 42', 43', 44' and 45' for grasping the specially shaped ends of the linking levers 27', 28', 31' and 32' (see FIG. 4), and are in each case mounted by means of a ball bearing 50 on the eccentrics 38 to 41. Adjusting spring connections 51 assure simple axial adjustment of all eccentrics.

The drive shaft 37, which is provided with a V-belt pulley 49, is mounted in a rugged pipe traverse 48 which, in its turn, is firmly screwed to the two vertical columns 2 of the machine housing and thus substantially contributes to the stability of the entire machine construction. Furthermore, this type of construction, together with the widened regions 2' of the columns 2 and the shape of the articulated and drive levers shown in FIG. 4, has the result that the entire eccentric drive and all ball bearings can be arranged outside the dusty inside of the mill, which constitutes a substantial advantage with respect to freedom from trouble and maintenance.

Figure 4:
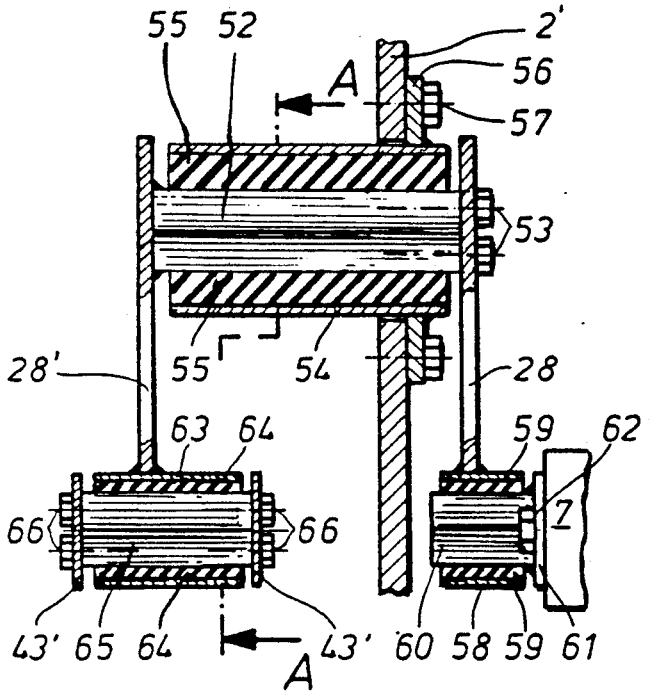
FIG. 4 is a linking and drive lever for the screen units, shown in section along the line IV—IV of FIG. 3 (in position of use, swung clockwise by 90° with respect to the plane of the section)
Figure 4A:
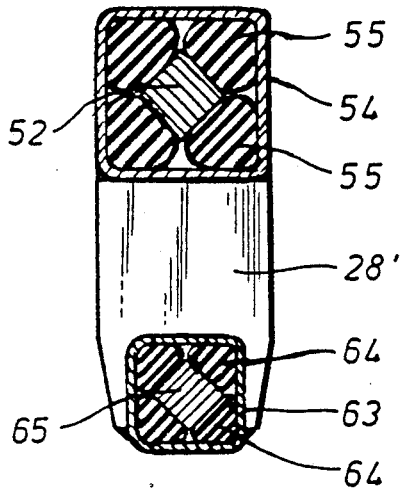
FIG. 4A is a section through the linking and drive lever along line A—A of FIG. 4.

As can be noted from FIGS. 4 and 4A, linking lever 28 and drive lever 28'—in the same way as the corresponding lever pairs 27, 27' and 31, 31' and 32, 32'—are firmly connected to each other by a square 52 and extend from the latter in the same direction and length downward, the connection to the square 52 being effected in the region of the linking lever 28 preferably by several screws 53 for reasons of assembly. The square 52 is contained in an also square length of pipe 54 which, however, is staggered by 45° with respect to the square 52 and the corner spaces of which are filled by correspondingly shaped sections 55 of a permanently elastic but at the same time rigid material, for instance hard rubber. Due to the connection of the pipe length 54 via its flange 56 and screws 57 to the columns or their regions 2' of the machine housing, there is thus obtained a mounting of the square 52 and thus of the levers 28, 28' in a rubber spring element, i.e. with a restoring moment with respect to the machine housing.

Similar mountings are provided at the lower ends of the levers 28, 28': The linking lever 28 for the screen unit 7 is provided at its lower end with a square pipe length 58 and a square 60 which is clamped therein between sections 59 in a manner analogous to the square 52 and is provided with a connection flange 61 which is attached to the screen unit 7 by means cf screws 62.

The drive lever 28, 28' welded to the other end of the square 52 also has at its lower end a square pipe length 63 with shaped sections 64 contained therein and consisting of rigid, permanently elastic material and a square 65 clamped between them. The square 65 is grasped at its ends by the open ends 43' of the connecting rod 43 and fastened between them by screws 66.

It is understood that instead of the rubber spring elements with square profile sections and square pipe lengths there can, for instance, also be used elements of circular or annular cross section as long as the connection between the permanently elastic material and the corresponding elements is sufficiently durable.

As a whole, the development of the linking and drive levers in the manner described requires relatively little expense while having, at the same time, a vibration and noise-damping effect such as has not been previously obtained in machines of this type. There is furthermore obtained in a simple and advantageous manner the desired spatial separation of all drive elements from the dust-filled inside of the machine.

Figure 5:
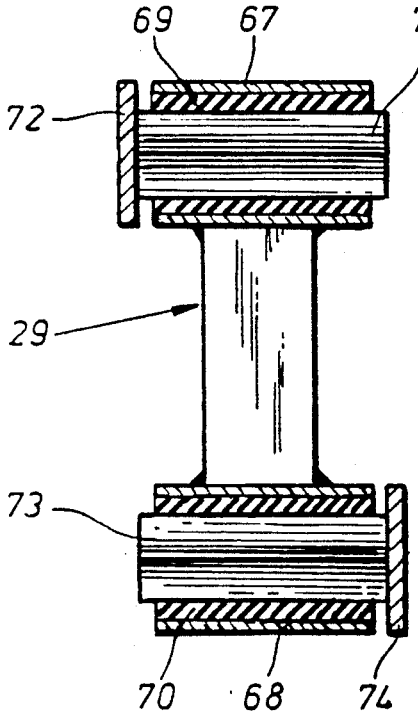
FIG. 5 is a linking lever for the screen units, shown in section along line V—V of FIG. 1.

The simple linking levers 29, 30, 33, 34, i.e. those which do not serve to drive the screen units 7, 8, are developed in accordance with a similar technology, as can be readily noted from FIG. 5 on the example of the linking lever 29. The latter terminates on top and bottom in square pipe lengths 67, 68 containing—always embedded, staggered by 90°, between rubber section 69, 70—an upper square 71 with an attachment flange 72 and a lower square 73 with an attachment flange 74 respectively. The flange 74 is screwed to the machine housing and the flange 72 to the screen unit 7.

Figure 3:
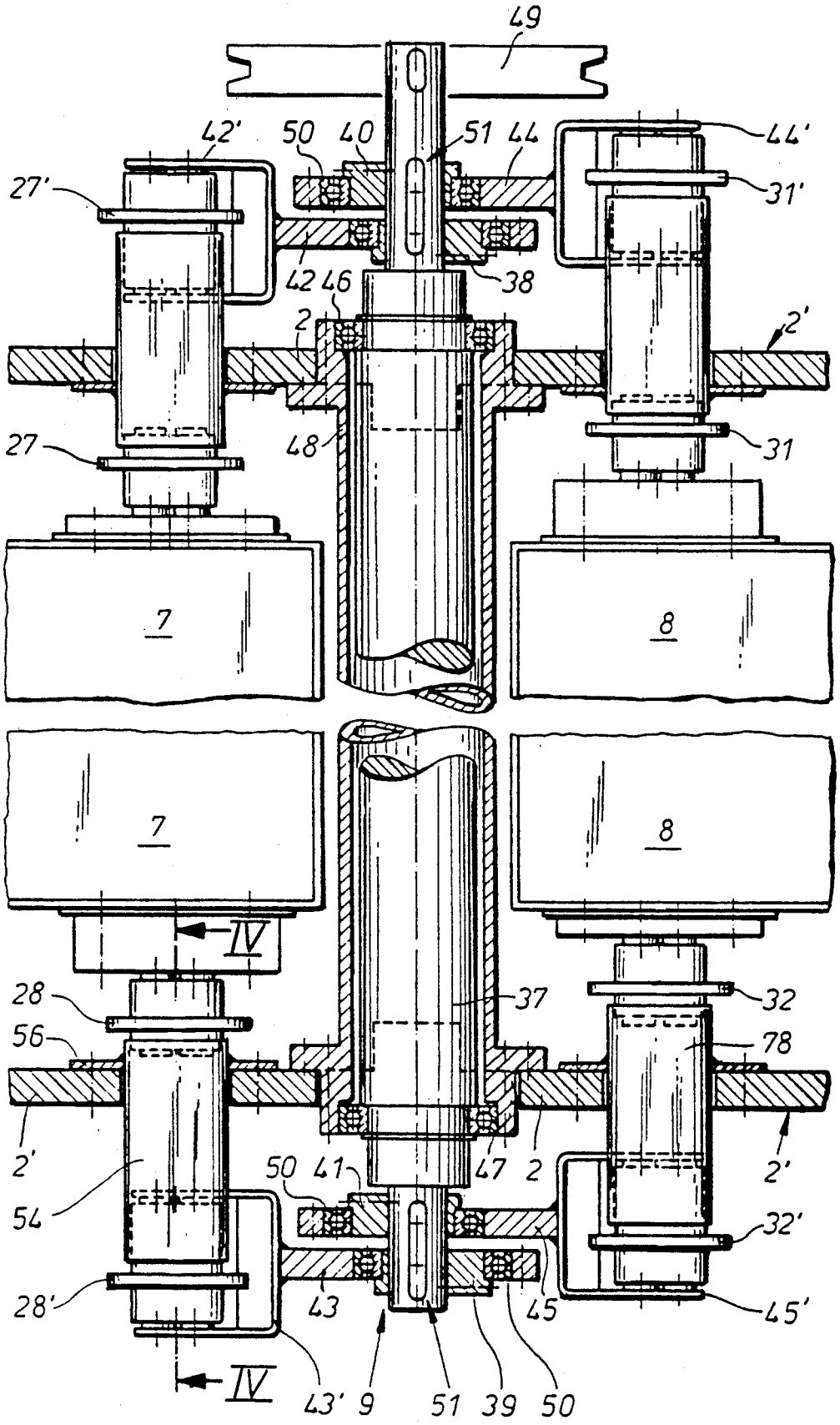
FIG. 3 is the drive mechanism for the screen units, shown in section along the line III—III of FIG. 1.
Figure 6:
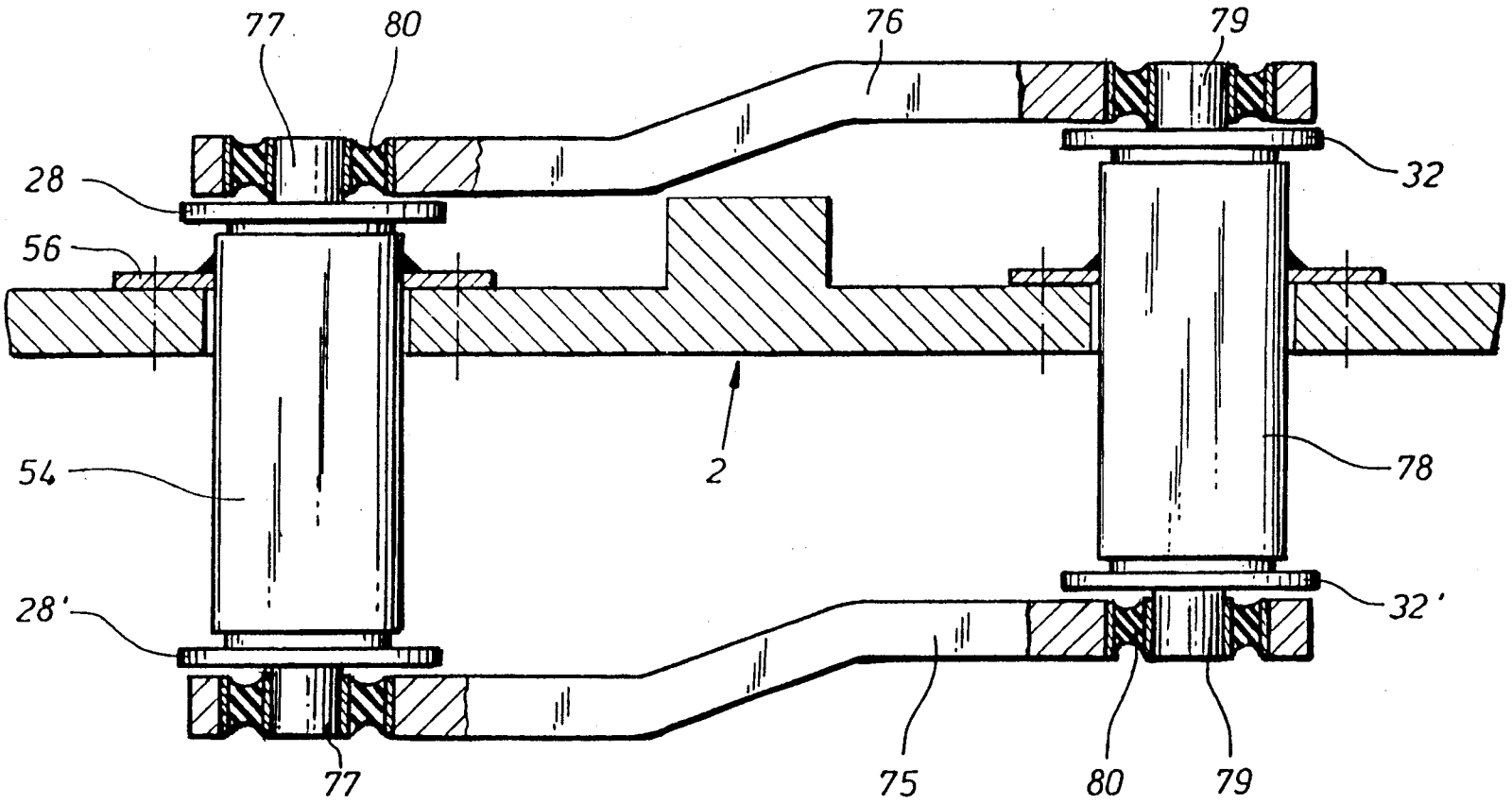
FIG. 6 is the connection of two adjacent linking and drive levers by stabilizer fish plates, shown in section along the line VI—VI of FIG. 1.

Since it is inherent in the nature of such rubber spring elements that their imaginary axes of rotation can effect slight yielding movements under the action of force and since this could have a disturbing effect, particularly with respect to the relatively long elements, such as, for instance, of the square 52, which connect the linking lever to the drive levers, stabilizer fish plates 75, 76 which dampen this effect are provided in accordance with FIG. 6. As can be noted, the square, which is guided in the region of the linking lever 28 and of the drive lever 28' in its housing or in the pipe length 54, is provided on both sides with protruding journal ends 77 and in the same manner the analogous square in the region of the levers 32, 32', which is arranged in a housing or pipe length 78, is provided with journal ends 79. These journal ends, which need not necessarily have a square profile, serve to receive the stabilizer fish plates 75, 76, the bent shape of which results from the axial stagger of the eccentrics 39, 41 and the connecting rods 43, 45 (FIG. 3). Also in this case rubber spring elements, for instance of annular shape and with corresponding rubber sections 80, are provided for damping. It goes without saying that, for reasons of symmetry, such stabilizer fish plates are also used in the region of the mounting of the linking and drive levers 27, 27' and 31, 31' on the opposite side of the machine.

FIGS. 7 to 9 show, on basis of a stylized showing of the screen units 7, 8 and a machine housing 81, a variant of the drive for the screen units in which one can dispense to a far-reaching degree with rotating elements and with housing wall openings for moveable parts.

The central element of this drive is formed by a swivel shaft 83 which is mounted in the walls of the housing 81, for instance by means of rubber spring elements 82, and which, via a lever 84 firmly attached to it, is placed in an oscillating reciprocating motion by an eccentric drive 85 and a connecting rod 86. On the swivel shaft 83, two two-armed drive levers 87 are mounted fixed in position and parallel to each other, the upward-directed arms of which serve to drive the screen unit 8 while their downward-directed arms serve to drive the screen unit 7. It goes without saying that this association can also be reversed and that, in position of rest, the levers need not necessarily assume a vertical position, as shown in FIG. 7.

Drive rods are in each case attached to the lever ends via rubber spring elements 88, namely one drive rod 89 and 90 each to the upper lever ends for the screen unit 8 and one drive rod 91 and 92 each to the lower lever ends for the screen unit 7. The linking of all drive rods on the screen units advisedly takes place also by means of rubber spring elements 93 and corresponding journal elements 93', in which connection it is to be noted that these journal elements are arranged in the plane of the center of gravity of the screen units. There is, of course, also the possibility of combining the articulating of the drive rods with that of the linking levers described below.

The screen units 7 and 8 are swingably suspended in the housing 81 on four linking levers each, which levers can be developed in a manner similar to the linking levers shown in FIG. 5. There are provided in detail the linking levers 94, 95, 96, 97 for the screen unit 7 and the linking levers 98, 99, 100 and 101 for the screen unit 8, FIG. 9 showing—as example for all linking levers, a section through the linking lever 100. It can be noted that rubber spring elements are used also in this case, their development being possibly simplified as compared with those of FIG. 6, in that the rubber spring elements 102—in the same manner as all other spring elements used in this drive variant—can have an annular rubber insert; and simple journal elements 103 can be used for the linking of them to the housing above the screen units.

Figure 10:
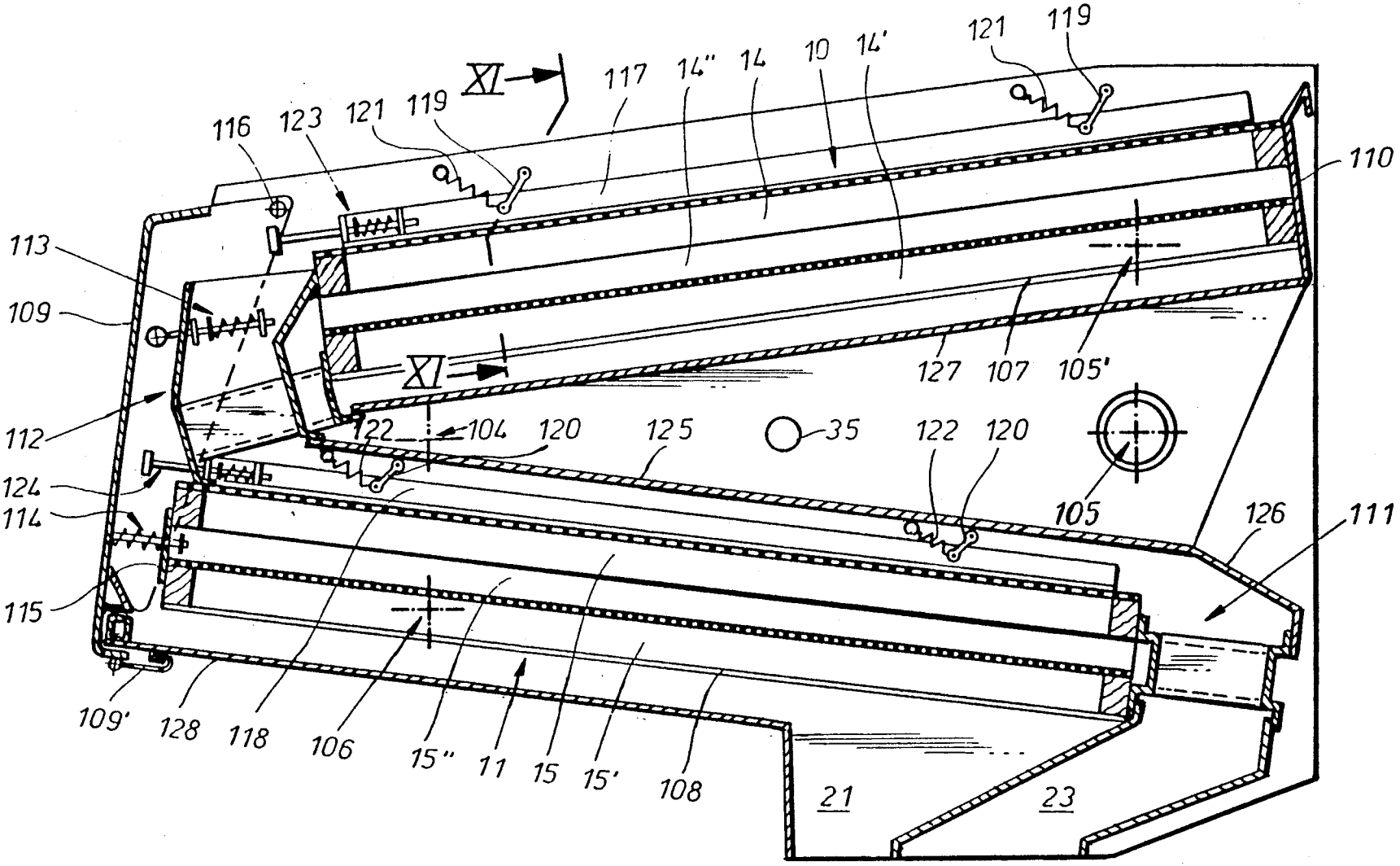
FIG. 10 is a screen unit, shown in section.

The screen unit shown in FIG. 10 is screen unit 7 of FIG. 1. Its linking point for the linking lever 29 is diagrammatically indicated at 104 and its linking point for the driven linking lever 27 at 105; the center of gravity 35 is located between them. The linking point of the linking lever 29 on the machine housing is designated 106 and that of the linking and drive lever 27, 27' on the machine housing is designated 105'. There can be noted an upper inclined screen compartment 10 which is formed essentially of two screen frames 14, 14' and, connected behind the latter, a lower screen compartment 11 which is also inclined and equipped in corresponding manner with two screen frames 15, 15'. Screen frames 14, 14' and 15, 15' are located on top of each other, separated in each case only by spacer strips 14'' or 15'', and are supported at the bottom on guide rails 107 or 108, arranged in pairs on the side. On these guide rails the screen frames are pushed in against rearward stops when the closure cover 109 of the screen unit 7 is opened in upward direction, said stops being formed in the case of the screen compartment 10 by a housing wall 110 and in the case of screen compartment 11 by a cross passage 111 arranged fixed in the screen unit for the fractions of materials obtained.

The locking of the screen frames in the direction of their inclination, i.e. in the direction of the guide rails 107, 108, with respect to the housing wall 110 or the cross passage 111 takes place by spring forces which enter into action upon the closing of the closure cover 109: On the closure cover 109 there is provided a further so-called cross passage 112 for the screen changeovers and the screen passages of the screen frames 14 and 14', which, however, is not rigidly fastened to the closure cover 109 but guided on it by spring pins 113. Additional spring pins 114 having a pressure plate 115 are provided on the closure cover 109 in the region of the screen compartment 11 so that, when the closure cover is swung around the shaft 116 into the closed position shown, the cross passage 112 is pressed, under the action of the springs of the spring pins 113, against the front surfaces of the screen frames 14 and 14'. The same occurs with the pressure plate 115 with respect to the screen frames 15 and 15', which plate, in the locked position of the closure cover 109' is secured by means of the cocking lever lock 109, under the tension of the spring pins 114 and presses the screen frames 15, 15' against the cross passage 111.

The pressing of the screen frames against the guide rails 107, 108 also takes place by spring force and is brought about by lowering the closure cover into the position shown: Lateral clamping ledges 117, 118 are in each case arranged on both sides above the screen frames 14 and 15. The ledges are swingably articulated on the screen unit by means of parallel links 119, 120 and are under the pulling action of springs 121, 122, so that the clamping ledges constantly tend to yield in upward direction and release the screen frames. This tendency is counteracted by spring pins 123, 124 which are activated upon the closing of the cover 109 by actuating members (not shown) arranged thereon. As a result in the closed position of the cover 109, the clamping ledges 117, 118 are lowered, swinging around the parallel links 109, 120, and are pressed against the screen frames under the pressure of the springs of the spring pins 123, 124.

It can be noted that a multiple effect thus occurs by the mere swinging down of the closure cover 109, in that the screen frames are locked both in the screen direction and perpendicular thereto, with simultaneous application against the cross passages 111 and 112. In conventional machines a large number of manipulations is required for this and screw attachments may even have to be loosened or tightened. Due to the action of the spring forces on all sides, there are furthermore neutralized in surprisingly simple manner all tolerances such as can occur by swelling or shrinkage, in particular in the screen frames, which are customarily made of wood.

With respect to the manner of action of the screen unit(s), it must be noted that the grist produced by the roll packages 4, 5 (FIG. 1, 2) is fed by the distribution device 20 onto the upper screen frame 14 approximately in the region of the housing wall 110, the screen mesh size of said frame being twice the size of that of the screen frame 14'. Since these conditions apply also for the screen frames 15, 15' and the absolute mesh sizes in the upper and lower screen compartment are of equal size, all husks, which are usually considerably larger than the largest mesh size, travel in the course of the screening or separating process via the screen of the screen frame 14 and the cross passage 112 onto the screen of the screen frame 15 and, from there, through the cross passage 111 into the discharge chute 23, from which they are drawn off.

The grist, i.e., all particles of a dimension smaller than the mesh size of the corresponding upper screen frames 14 and 15, passes over the screen surface of the screen frame 14', unless it is still carried along by the husks, and arrives through the cross passage 112 directly on the bottom 125, the terminating inclined surface 126 of which feeds some to the pair of rolls 6 (FIG. 1) for further grinding. The grist carried along by the husks reaches, via the cross passage 112 and subsequent passing of the coarse mesh screen frame 15, the screen surface of the screen frame 15', from which it is admixed, with passage through the cross passage 111, with the above-mentioned grist for further grinding.

The flour finally collects continuously on the flour bottom 127 or the flour bottom 128, to which it passes after passing through the cross passage 112 or the screen frame 15' in order to be finally drawn off through the discharge chute 21. As a whole, the large screen surface realized in a narrow space leads to a very high screening performance.

Figure 11:
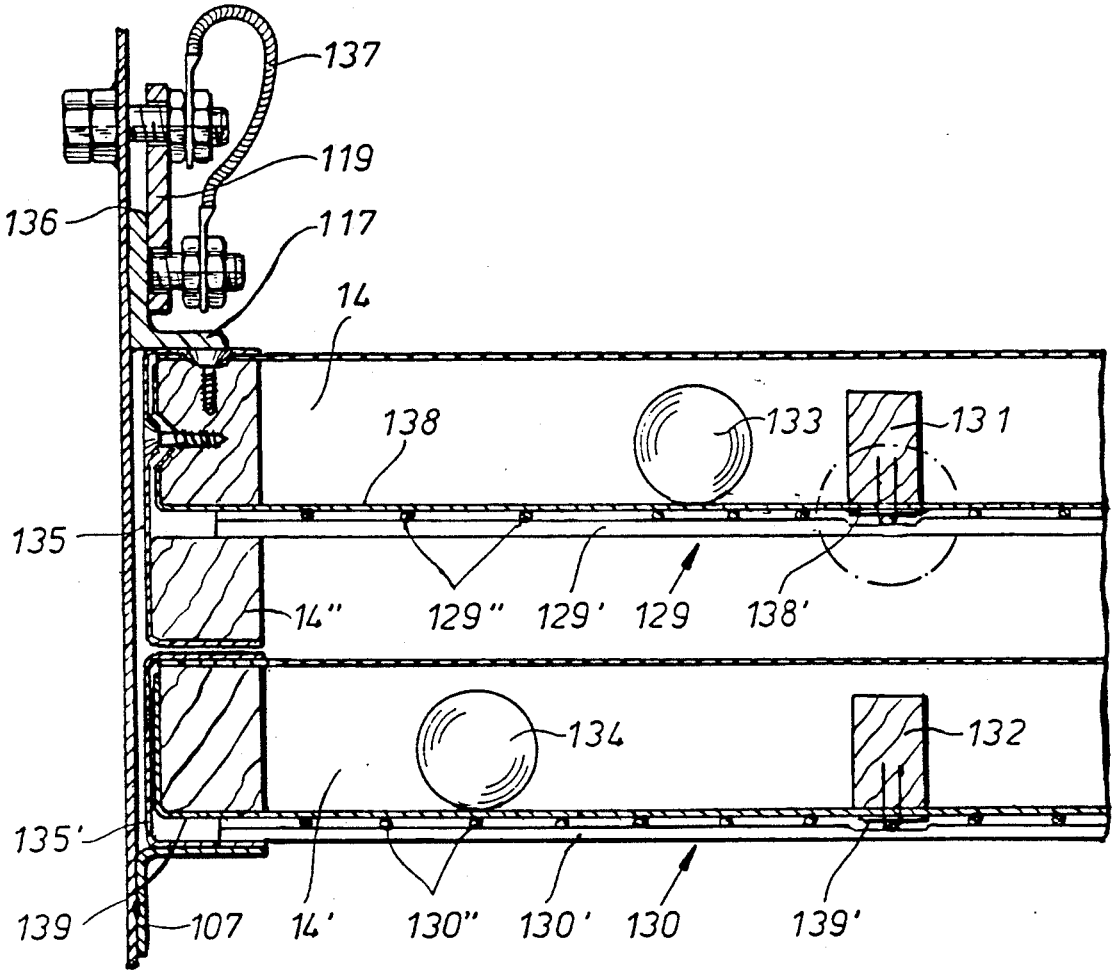
FIG. 11 is a partial section through the screen unit in accordance with the section XI—XI of FIG. 10.

Some measures with a view toward the explosion-proofing of machines of the type in question here, which must be considered to an increased extent particularly in the case of higher throughputs, can be noted from FIG. 11. Grounding measures are required for the leading away of electrostatic charges which occur particularly upon the operation of oscillating screens. This applies not only to the screen surfaces themselves but also to the ball bottoms forming the bottom closure of each screen frame. There is concerned here a wire mesh which is relatively coarse as compared with the actual screen surface, the surface of which is subdivided into numerous chambers by intersecting webs which are connected to the actual frame of the screen, said chambers containing balls or other suitably shaped bodies which, due to their constant movement during the screening process, prevent the formation of a deposit of material on the screens.

FIG. 11 shows such ball bottoms 129, 130 as bottom closures of the screen frames 14, 14'. The wire mesh consists of intersecting wires 129', 129'' or 130', 130'', and the surfaces formed by them are subdivided by webs 131, 132 into individual regions in which the balls 133, 134 are located.

As can be noted, in the region of the clamping ledges 117, both the screen frame 14 and the spacer bars 14'' are surrounded by a framing 135 in the form a metal strip which is correspondingly bent twice and for which there is selected a material of good electric conductivity. The lower screen frame 14' is surrounded in analogous manner, with inclusion of the ball bottom 130, by a framing 135'. Upon a lowering of the clamping ledges 117 by means of the parallel links 119, the screen stack is pressed together and against the guide rails 107, the framings 135, 135' creating a connection of good electrical conductivity between the screen surfaces of the screen frames 14, 14' and the ball bottoms 129, 130, in particular to the guide rails 107 or 108 and the clamping ledges 117 or 118. In order to assure with absolute certainty an electrically conductive connection to the screen unit 7, a portion 136 of the wall of which is shown, grounding strips 137 are provided which connect the shafts of the parallel links 119 to each other. For the further improvement of the leading away of electrostatic charges from the entire region of the ball bottoms 129, 130, there are finally applied between the latter and the webs 131, 132, strips 138, 138' or 139, 139' which extend at right angles to each other and consist of material which is also of good electric conductivity.

Figure 12:
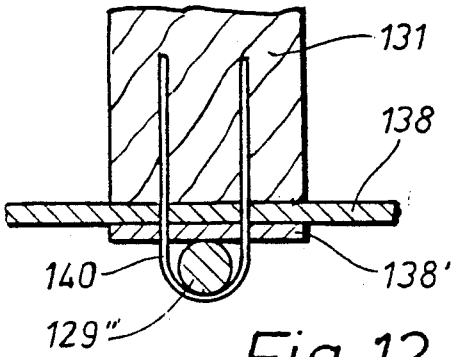
FIG. 12 is a detail of FIG. 11.

FIG. 12 shows, on basis of an enlargement of the details surrounded by a circle in FIG. 11, how the strips 138, 138' intersect in the region of the web 131, the strip 138' extending perpendicular to the plane of the drawing lying below the strip 138. The flat application of the strips against each other in the area of intersection is effected by a clamp 140 which is driven into the web 131 and, in this case, simultaneously surrounds the wire length 129'' of the ball bottom 129. At the next place of intersection, the clamp 140 driven in there then grasps a wire length 129', then again a wire length 129'', etc., so that the clamps 140 in their entirety assure the attachment of the ball bottoms 129, 130 to the webs 131, 132.

Figure 13:
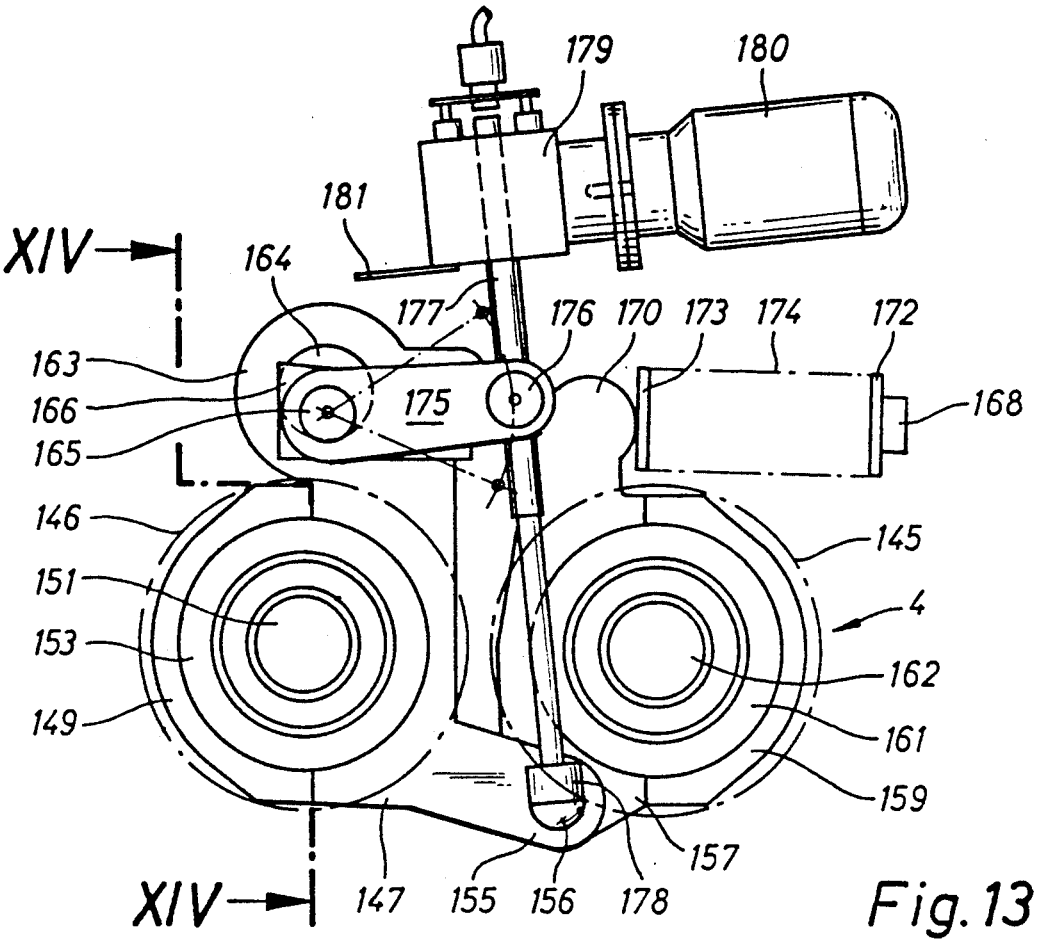
FIG. 13 is a detail of FIG. 2, shown on a larger scale.

The enlarged detail of FIG. 13 shows the roll package 4 which is developed as a self-contained structural unit and consists of the pairs of rolls 145, 146, it being described as being representative also of the identically developed roll packages 5 and 6.

Figure 15:
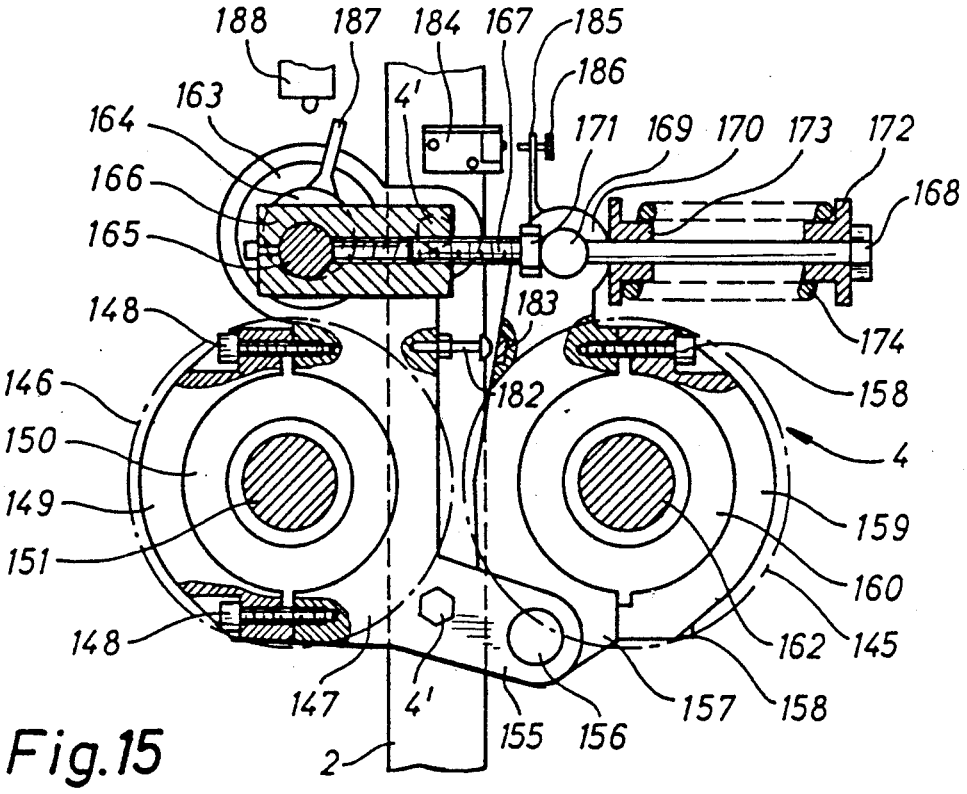
FIG. 15 is a section XV—XV of FIG. 14.
Figure 14:
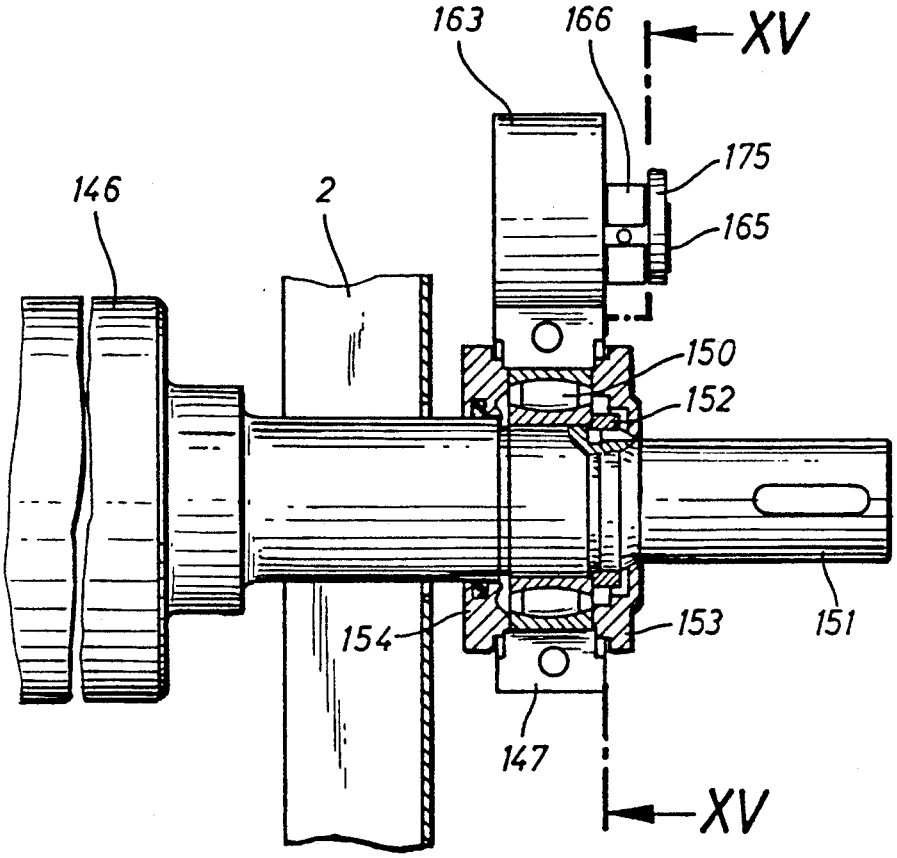
FIG. 14 is a section along the line XIV—XIV of FIG. 13.

The roll package 4 containing the rolls 145, 146 has a bearing base 147 which forms one of the bearing shells for the roll 146. A removable bearing shell 149 is firmly attached to it by screws 148. A self-aligning roll bearing 150 (FIGS. 14 and 15) is clamped between the two, in which the stub shaft 151 on the end of the roll 146 is rotatively mounted. The self-aligning roll bearing 150 is laterally secured by a nut 152 and covered by bearing covers 153, 154 screwed to each other. The second stub shaft of the roll 146 is mounted in the same manner at the opposite end (not shown). The removal of the roll 146 therefore takes place in the manner that the screws 148 are loosened and the bearing shell 149 is removed, whereupon the roll is free and can be removed horizontally toward the one side of column 2. Thereupon the self-aligning roll bearing 150, the bearing covers 153, 154 and the nut 152 can be removed from the stub shaft 151.

The bearing base 147 extends with a tongue 155 beyond the column 2 toward the roll 145 and has a journal pin 156 at the free end of the tongue, on which a moveable bearing shell 157 is articulated in such a manner that it can be swung against the bearing base 147 or away from it. By means of screws 158 a bearing shell 159 is detachably fastened to said moveable bearing shell 157. A self-aligning roll bearing 160 is clamped between the removable bearing shell 157 and the bearing shell 150 (as has already been described with reference to roll 146), the roll bearing being laterally covered by bearing covers 161. The stub shaft 162 of the roll 145 is mounted for rotation in the self-aligning roll bearing 160. The rolls 145, 146 are mounted in the same manner at the invisible end and are equipped, in addition, with drive means which drive them with different speeds.

For the drive, each pair of rolls 145, 146 has a drive disk on the shaft of the rapidly rotating, stationary roll 146. The transmission from the roll 146 to the slowly rotating moveable roll 145 takes place by a chain drive or spur gears.

For the engaging or disengaging of the two rolls 145, 146 or for the adjusting of the grinding nip, the bearing base 147 has at its upper end, on both roll ends, a bearing eye 163 in which a shaft 164 with an eccentric pin 165 is mounted freely rotatable. A clamp 166 in which a screw 167 with a screw head 168 is firmly clamped, is swingably mounted on the eccentric pin 165. The screw 167 passes through a spherical nut 169 which is mounted rotatably in a bearing head 170 cf the bearing shell 157. A nut 171 which rests against the spherical nut 169 is screwed on the screw 167. A spring 174 is located between a spring bearing 172 resting against the screw head 168, and a spring bearing 173 resting against the bearing head 170. The initial tension of the spring 174 is selected by adjusting the nut 171. It serves as overload safety if during the grinding a hard foreign body should pass between the rolls 145, 146. In such event, the bearing shell 157 together with the roll 145 can swing outward against the action of the spring 174, whereby mechanical damage to the pair of rolls is prevented. Installation and removal of the roll 145 take place in the same manner as in the case of the roll 146. After loosening the screws 158, the bearing shells 159 on both roll ends are removed and the stub shaft 162 is exposed. The roll can then be removed horizontally (away from the column 2).

The adjustment of the roll nip takes place on both roll ends by turning the shaft 164. For this purpose, the end of a lever 175 is articulated on the eccentric pin 165, a swivel pin 176 being mounted rotatably in the other, forked end of said lever. An internal thread, into which a spindle 176 has been screwed, extends diametrically in the swivel pin 162. The lower end of the spindle is mounted, freely rotatable, in a bearing 178 firmly attached to the shaft journal 156, so that the spindle 177 can be swung with the shaft journal 156. The spindle 177 is connected fixed for rotation and axially with the driven shaft of an angular gear 179 which is flanged on the drive side to a brake motor 180. The angular gear 179 is supported by a torque support 181. On the one hand, it can thereby follow a swinging movement of the spindle 177 and, on the other hand, the torque produced by the brake motor 180 is compensated for by the machine housing. By a turning of the spindle 177 by means of the brake motor 180, the swivel pin 176 follows a circular arc around the center of the shaft 164 and turns the latter. The clamp 166 and the screw 167 are displaced with the eccentric pin 165 and swing the bearing shell 157 or the roll 145 around the shaft journal 156 at both the roll ends.

Figure 2:
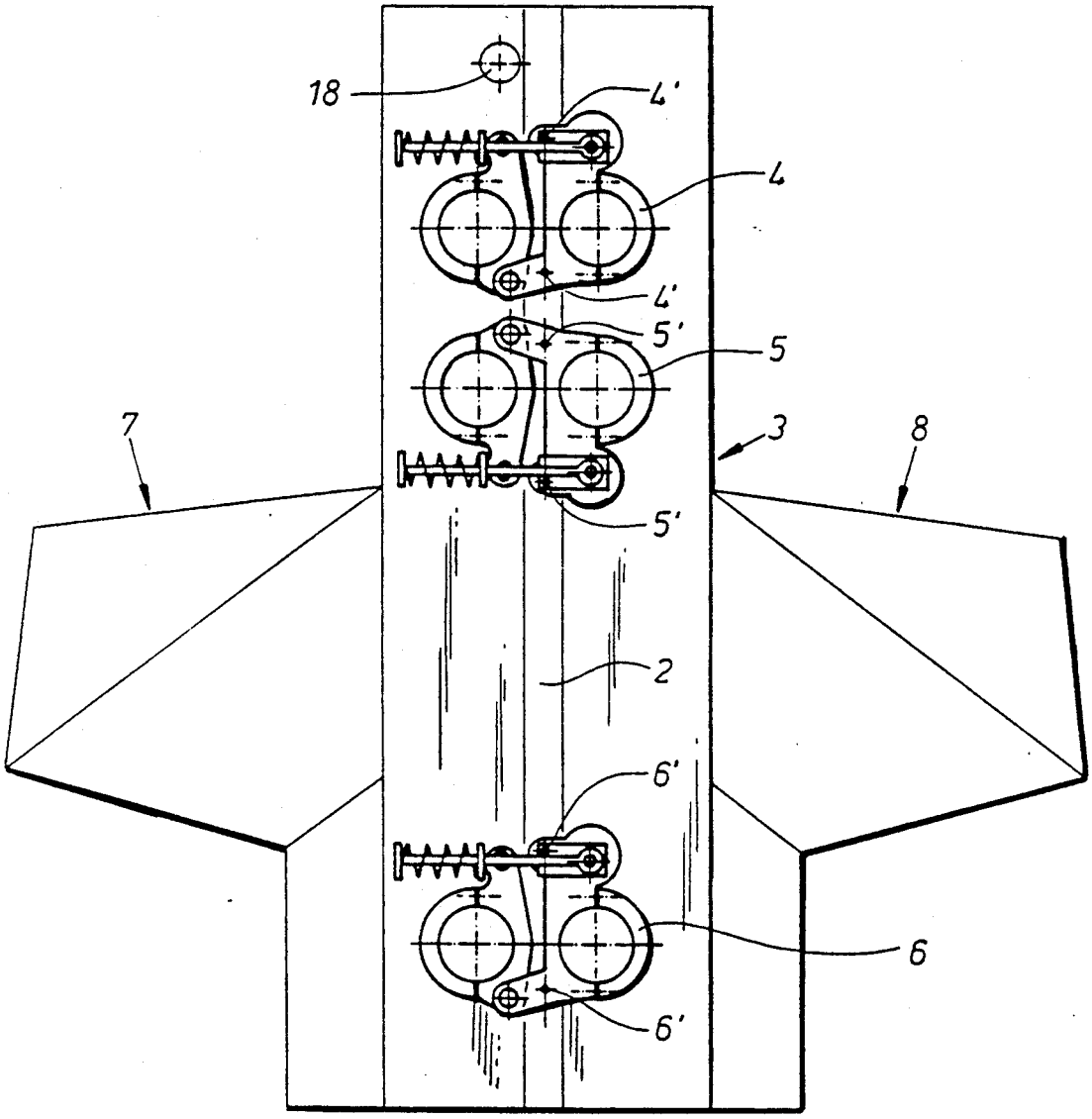
FIG. 2 is a view of the malt crushing mill of FIG. 1 with the covering of the central portion removed, also in a greatly simplified showing.

The bearing base 147 extends over a relatively large area in vertical direction of the column 2 and forms a long lever parallel to the column 2. At its upper and lower ends there is in each case provided a screw connection 4' by which it is attached to the column 2. The connecting straight line between the two screw connections 4' extends essentially parallel to the column 2 and lies, in rough approximation, in the center between the rolls 145, 146. The distance between the points of attachment is preferably equal to or greater than the distance between the shafts of the rolls 145, 146. In this way, the forces transmitted to the column 2 by the roll drive and by the rolls 145, 146 which rotate at different speeds are comparatively small and, as a matter of fact, are smaller, the larger the distance between the screw connectors 4', i.e. the longer the active lever. The arrangement of the rolls 145, 146 on opposite sides of the column 2 furthermore results (at least in rough approximation) in a symmetrical loading of the column 2 so that it can be made slender and of light weight. In the case of multiple roll frames (as shown in FIGS. 1 and 2) in which the roll packages 4, 5, 6 are arranged vertically above each other, the straps 155 with the shaft journal 156 are preferably arranged alternating on top and bottom in the case of the bearing housing of the stationary rolls 146, which furthermore favors a symmetrical loading of the columns 2. In such multiple roll frames there is furthermore the advantage that each roll can be detached unimpeded by other machine parts and removed toward the side.

Each of the bearings of the roll packages 4, 5, 6 forms a self-contained articulation frame within which the forces and bending moments occurring during the grinding are in equilibrium. Therefore, they need not be taken up by the columns 2. The latter are exclusively subject to loading by the weight of the roll packages and by the drive torques. This load, however, is distributed substantially uniformly toward both sides. Since the rolls 145 and 146 are mounted in the same manner at both ends, the parallel setting of the rolls 145, 146 takes place in horizontal direction by the screw 167 by screwing it (at both roll ends) to a greater or lesser extent into the clamp at 166. The initial spring tension is always retained in this connection since the nut 171 is secured to the screw 167 by a setscrew.

The horizontal placing of the rotating shafts of the rolls 145 and 146 is effected by swinging the bearing housings around the lower screw of the screw connection 4', 5' or 6' with subsequent fixing in position of the bearing base 147 by tightening both screws. The parallel position of the rolls 145, 146 is obtained by screwing the screw 167 to a greater or lesser extent into the clamp 166.

Due to the resting of the spring bearing 173 against the bearing head 170, the spring 174 pulls the screw 167 with the nut 171 against the spherical nut 169, which is thereby pressed in its bearing in the bearing head 170 against the side facing the spring bearing 173. Since the grinding forces extend in the same direction, a play-free supporting of the spherical nut 169 in the bearing head 170 is assured, resulting in the advantage that upon swinging movements of the bearing shell 157 the screw forces (=grinding forces) always extend through the center of the spherical nut 169.

Due to the adjustment of the roll distance by motor there is the danger that the rolls 145, 146 roll empty on each other because of a faulty control by the electronic system. With the rolls 145, 146 rolling, this can cause considerable damage. In order to prevent this, an adjustable stop screw 182 is screwed into the bearing base 33 at both roll ends, said stop screw so cooperating with a stop plate 183 arranged fixed on the moveable bearing shell 157 that movement of the rolls against each other is mechanically prevented. Furthermore, a stationary safety switch 184 is connected to the column 2, which switch can be actuated by sensors 185 attached to the moveable bearing shell 157. The switch point can be adjusted by micrometer screw 186. These safety switches 182 have their switch point below the grinding nip but above the roll contact so that the rolls can be stopped before they contact each other.

The shaft 164 is provided with a position of rotation indicator 187 which cooperates with a reference switch 188 which is stationary (i.e. firmly attached to the column 2). The reference switch 188 and the position of rotation indicator 187 are so coordinated with respect to each other that the latter closes a switch contact in the former with a switch precision of +2/100 millimeter when the moveable roll 145 has reached its disengaged position. The reference switch 188 signals, upon the disengaging of the rolls, that the defined disengagement path has been reached within the indicated tolerance. If this signal is not given off at the end of the disengagement process, displacement is possibly present and the rolls are automatically disconnected.

Figure 16:
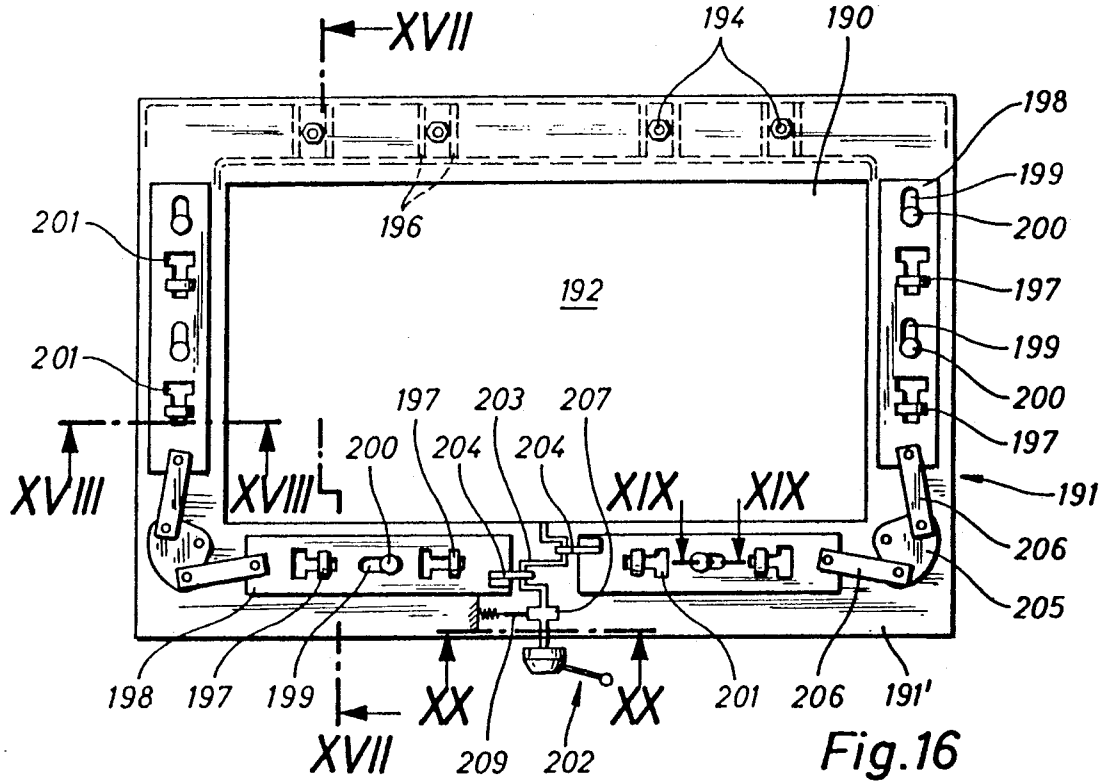
FIG. 16 is a view of the bottom side of an opening of the machine housing with the flap or hood closed.
Figure 19:
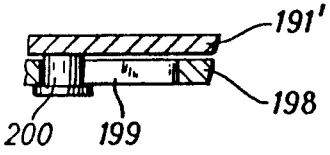
FIG. 19 is a guide for the bolts in the edge region of the opening of the machine housing corresponding to the section line XIX—XIX of FIG. 16.
Figure 20:
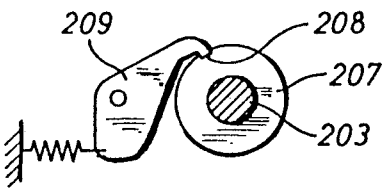
FIG. 20 is a section along the line XX—XX of FIG. 16 which shows the locking possibilities for the actuating member of the bolts.

FIG. 16 shows, as representative of several housing openings provided on a device for the grinding and separating of grain, a rectangular opening 190 in the machine housing 191, seen from the inside of the machine, the showing thereof being restricted in this case to the edge region 191' which cooperates with the flap 192, which can also have the shape of a dome-shaped hood.

The flap 192, which is shown in closed position, is developed as shell construction with cover plates 192' and a stability-increasing and at the same time soundproofing sandwich filling 193 preferably introduced between said cover plates, and it is swingably articulated on the machine housing 191 by four hinge eyes 194 screwed to the edge region 191' of the machine housing 191 and hinge pins 195 engaging in said eyes. The hinge pins 195 are firmly anchored between corresponding webs 196 of the flap.

Figure 18:
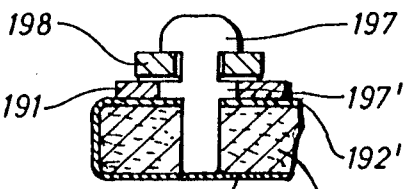
FIG. 18 shows a hook-bolt engagement along the section line XVIII—XVIII of FIG. 16.
Figure 17:
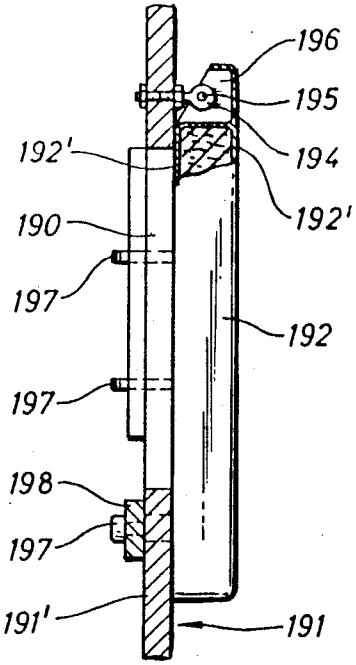
FIG. 17 is a section along the line XVII—XVII of FIG. 16.

In the region of its free edges, i.e. the edges not provided with hinge pins 195, a total of eight hooks 197 are recessed into the flap 192, namely in each case two at the edges adjacent to the swivel shaft and a total of four at the edges opposite the swivel shaft. As can be noted from FIG. 18, these hooks 197 are of double-T shape and are welded to the shell plates 192' of the flaps 192.

In order to receive the hooks, rectangular recesses are provided in the edge region 191' of the machine housing 191, the hooks 197 passing through said recesses or the recesses surrounding the flanges 197' of the hooks. Below said recesses, displaceable tie bars 198, cooperating with the hooks 197, are provided, namely in each case one in the zones of the edge region 191' adjacent the swivel shaft and two in the part of the edge region 191' opposite the swivel shaft. The tie bars 198 are developed as flat sections which are guided longitudinally moveable by means of slots 199 on holding pins 200 attached to the machine housing 191 or its edge region 191'. Each tie bar 198 is furthermore provided with two T-shaped engagement openings 201 into the regions of which corresponding to the "T" crossbar the heads of the hooks 197 enter when closing the flap 192. It can readily be noted from FIGS. 16 and 18 that, when the tie bars 198 are subsequently moved into the locking position shown, the hooks 197 are fixed in position with their heads on both sides of the region of their T-shaped engagement openings 201. This region extends in the direction of the tie bars 198, and the flap 192 thus rests firmly against the machine housing 191 or its edge region 191' via a total of four pivot points 194, 195 and eight hooking points 197, 198, 201.

As can further be noted from FIG. 16, the actuating of all tie bars 198 takes place simultaneously by means of a hand lever 202, which is arranged on a shaft 203 which is bent twice in opposite directions. The shaft 203 is connected by linking members 204 to the tie bars 198 located in the forward edge region 191' of the machine housing 191, so that said tie bars can moved either away from each other or toward each other, the former movement—as shown—corresponding to the closed position of the flap 192 and the latter movement in the end position to the open position of the flap 192 since in that case the hooks 198 are released again from their engagement openings 201.

The transfer of the movements described to the tie bars 198 takes place by means of two swivel segments 205 arranged in the forward corners of the edge region 191' of the machine housing 191, adjacent tie bars 198 being connected to said swivel segment 205 by linking elements 206.

For locking in the closed position, there is furthermore provided on shaft 203 a disk 207 having a locking notch 208 and a spring-loaded pause 209 cooperating with said notch.

It goes without saying that the shaft 203 and the disk 207 can also be combined into a single disk with two pivot points, arranged 180° apart from each other, for the linking members 204. Furthermore, the hand-lever position can also be secured in the closed position by a commercially available lock so as to prevent unauthorized opening of the flap 192. Additional securing can be provided by electric control elements which permit the opening of the flap 192 when the machine is stopped.

I claim:

1. A roller mill comprising; frame means;

a pair of elongated upright supporting means on said frame means, arranged parallel to each other;

a first and a second pair of rollers extending between said supporting means for grinding material, each roller having two ends, said first pair of rollers being arranged in a first horizontal plane above said second pair of rollers arranged in a second horizontal plane, the rollers of each pair being separated from each other by a common vertical plane;

a first and a second pair of fixed bearing housings supported by said supporting means, the bearing housings of respective pairs of the bearing housings being spaced to receive the ends of one of said rollers of respective ones of said roller pairs;

a first and a second pair of movable bearing housings supported by said supporting means to receive the ends of the other one of said rollers of respective ones of said roller pairs, there being separating forces acting on the respective roller pairs in operation of the mill;

adjustable loading means operative between said fixed bearing housings and said movable bearing housings to contain the separating forces acting on the respective roller pairs, independently from said supporting means;

sieving means arranged above said second pair of rollers and below said first pair of rollers to separate fined from oversized pieces of material ground by said first roller pair, said sieving means comprising a pair of sieving units of equal inertia and having each a center of gravity, each sieving unit being arranged symmetrically with respect to said vertical plane and being substantially movable within a third horizontal plane; and drive means for said sieving means, said drive means driving each of said sieving units in said pair of sieving units in opposite direction to move over a predetermined range of movement.

2. Roller mill as claimed in claim 1, wherein each of said sieving units comprises two sieving sections arranged in series one above the other, each of said sieving sections being inclined in a manner to assist the material in flowing from said first pair of rollers to said second pair of rollers.

3. Roller mill as claimed in claim 2, further comprising cover means arranged on one end, distant from said vertical plane, of each of said sieving sections to provide an access to the latters, said cover means including product guide means for said fines and said oversized pieces of material.

4. Roller mill as claimed in claim 2, further comprising at least one pair of guide means for each of said sieving sections, said guide means being inclined in the direction of the inclination of said sieving sections to enable the same to be drawn out, each of said sieving sections comprises two sieve frames situated one above another.

5. Roller mill as claimed in claim 4, further comprising elongated urging means for urging said sieve frames toward one another and towards said guide means.

6. Roller mill as claimed in claim 5, further comprising a pair of pivoted levers having freely movable ends pivoted on said elongated urging means for guiding them parallel towards said sieve frame; and spring means acting upon said pivoted levers.

7. Roller mill as claimed in claim 5, further comprising biasing means comprising springs acting in the direction of inclination of said sieving sections for limiting movement of said sieving sections.

8. Roller mill as claimed in claim 7, further comprising cover means arranged on one end, distant from said vertical plane, of each of said sieving sections to provide an access to the latters, said cover means including product guide means for said fines and said oversized pieces of material, said biasing means being arranged on said cover means to be actuated by the latter.

9. Roller mill as claimed in claim 5, wherein said sieving means comprises electrically conductive surrounding frame means, said elongated urging means resting upon said surrounding frame means; and conductor means connected to said elongated urging means to conduct electrical loads from said sieving means to ground.

10. Roller mill as claimed in claim 9, wherein said sieving means comprises a sieve cleaner deck and conductor tape means connected with one end to said sieve cleaner deck and with a second end to said surrounding frame means.

11. Roller means as claimed in claim 1, further comprising two pairs of pivot levers pivoted each about an axis on said frame means, the pivot each about an axis on said frame means, the pivot levers of each pair being spaced from each other to receive and hold one of said sieving units, the levers in each lever pair being at least approximately equally spaced from said center of gravity.

12. Roller mill as claimed in claim 11, wherein said pivot levers are in vertical position when said drive means is inoperative.

13. Roller mill as claimed in claim 11, wherein the length of said pivot levers amounts to about five times to thirty times the length of said range of movement.

14. Roller mill as claimed in claim 11, wherein the length of said pivot levers amounts to about eight times to ten times the length of said range of movement.

15. Roller mill as claimed in claim 11 wherein said drive means comprises drive levers connected to said pivot levers.

16. Roller mill as claimed in claim 15, further comprising elastic connection toward and on the free end of at least one of said drive levers and said pivot levers.

17. Roller mill as claimed in claim 15, further comprising a plurality of pivoting shaft means extending along said axes and connecting said drive levers with said pivot levers.

18. Roller mill as claimed in claim 15, wherein said pivot levers are arranged on a first side of said frame means turned towards said sieving units, whereas said drive levers are situated on a second side of said frame means opposite said first side of said frame means.

19. Roller mill as claimed in claim 18, further comprising rubber spring means arranged around said pivoting shaft means; and a housing surrounding said rubber spring means and said pivoting shaft means and being fixed to said frame means, said pivoting shaft means having a polygonshaped cross-section.

20. Roller mill as claimed in claim 19, further comprising orienting means for the pivoting shaft means within said housing, said orienting means connecting the pivoting shaft means in order to ensure a predetermined distance from each other.

21. Roller mill as claimed in claim 20, wherein said drive means comprise a drive shaft arranged horizontally within said vertical plane;

a pair of cam means, each cam means being identically formed, but being offset with respect to each other by 180°; and cam follower means assigned to each of said cam means and being connected to said sieving means to impart movement to them;

and said mill further comprises elastic connection means on the free ends of said drive levers, said cam follower means having bifurcated ends to hold said elastic connection means on each side of a driver lever.

22. Roller mill as claimed in claim 1, wherein said drive means comprise a drive shaft arranged horizontally within said vertical plane;

a pair of cam means, each cam means being identically formed, but being offset with respect to each other by 180°; and cam follower means assigned to each of said cam means and being connected to said sieving means to impart movement to them.

23. Roller mill as claimed in claim 22, further comprising a hollow tube-shaped traverse extending from a side of one of said supporting means to a side of the other one of said supporting means to stiffen said frame means, said drive means being arranged within said hollow tube-shaped traverse.

24. Roller mill as claimed in claim 23, further comprising anti-friction bearing means for bearing said drive shaft, said anti-friction bearing means being arranged within said hollow tube-shaped traverse.

25. Roller mill as claimed in claim 1, wherein said drive means comprise a horizontal drive shaft located at said vertical plane;

oscillating drive means connected to said drive shaft for imparting an oscillating movement to it; and at least one pair of connecting rods connecting said drive shaft to a respective one of said sieving units.

26. Roller mill as claimed in claim 25, further comprising rubber spring means arranged around said drive shaft.

27. Roller mill as claimed in claim 25, further comprising rubber spring means arranged on a connection of said connecting rods with said drive shaft and at least one of said sieving units.

28. Roller mill as claimed in claim 1, further comprising a third pair of rollers arranged parallel to said first and second pair of roller means and being interposed between said first pair of roller means and said sieving means.

29. Roller mill as claimed in claim 1, wherein said sieving means is arranged with respect to said second pair of rollers as to deliver said oversized material to said second pair of rollers, whereas said fines pass said second pair of rollers without being ground by them.

30. Roller mill comprising:

frame means;

a pair of upright supporting means arranged parallel to each other and disposed on said frame means;

first material treating means mounted on said frame means; and wherein said treating means comprises:

a pair of rollers extending between said supporting means, each roller having two ends and a longitudinal rotational axis extending between said two ends, said pair of rollers being arranged in a first horizontal plane, the rollers being separated from each other by a common vertical plane;

a pair of fixed bearing housings supported by said supporting means, the fixed bearing housings being spaced to receive the respective ends of one of said rollers, the fixed bearing housings being mounted on said supporting means at two fixed points situated substantially vertically one above another;

a pair of movable bearing housings supported by said supporting means to receive the respective ends of the other one of said rollers;

gap setting means interconnected between said fixed and said movable bearings for setting a desired gap between said rollers, there being separating forces acting on said rollers during operation of the mill; and wherein said gap setting means includes adjustable loading means operative between said fixed bearing housings and said movable bearing housings to contain the separating forces acting on said rollers, independently from said supporting means, said adjustable loading means enabling a quick increase of said gap in the even of a foreign object entering the gap; and wherein said bearing housings are interconnected by said frame means and said gap setting means by a first and a second connection, the first connection being above the axes of the rollers, the second connection being below the roller axes to form a hinged frame; and the mill further comprises second material treating means arranged below said first material treating means along said vertical plane.

31. Roller mill as claimed in claim 30, wherein said movable bearing housings are hinged on said frame means.

32. Roller mill as claimed in claim 30, wherein said fixed bearing housings are each divided into two halves along a substantially vertically extending dividing plane, said halves being releasably interconnected with each other.

33. Roller mill as claimed in claim 32, wherein said gap setting means interconnect the halves of said bearing housings.

34. Roller mill as claimed in claim 32, wherein said fixing points are located at the halve of the respective fixed bearing housing which lies adjacent said vertical plane.

35. Roller mill as claimed in claim 32, wherein said fixed bearing housings comprise a projection on a halve situated adjacent said vertical plane, said projection extending in a direction towards said movable bearing housing and supporting a hinge pin for guiding the latter.

36. Roller mill as claimed in claim 35, further comprising a first and a second releasable interconnecting means for interconnecting said halves, the first interconnecting means being situated above said projection, the second interconnecting means being situated below said projection.

37. Roller mill as claimed in claim 30, wherein the distance between said fixing points amounts approximately at least to the distance between the axes of said pair of rollers during operation of the mill.

38. Roller mill as claimed in claim 30, wherein said pair of upright supporting means comprises a pair of column means onto which said pair of fixed bearing housings is mounted, there being an axle on each of the front ends of each roller, the axles extending between said column means.

39. Roller mill as claimed in claim 30, wherein said second material treating means comprises at least one other pair of rollers.

40. Roller mill as claimed in claim 30, wherein said second material treating means comprise at least one pair of sieves.

41. A roller mill comprising housing means enclosing a working space substantially from all sides, said housing means including fixed housing means;

cover means for providing an access from outside to said working space and being arranged to cover an opening of said fixed housing means;

hinge means for pivotally connecting said cover means to said fixed housing means, said hinge means comprising a plurality of hinge elements;

first and second locking means on said hinge elements and said fixed housing means within the region of said opening for releasably locking said hinge elements on said fixed housing means;

hinge moving means connected to at least part of one of said first and second locking means to unlock the pivotal connection of said cover means and said fixed housing means; and material treating means within said working space, said treating means comprising at least one pair of rollers; and wherein said first and said second locking means comprise respectively hook means, and latch means for gripping said hook means; and said latch means comprise a pair of first latching elements disposed along one margin of said opening opposite to said hinge means;

a pair of second latching elements each disposed along an other margin of said opening opposite to each other; and a pair of motion transfer elements for transferring motion from one of said first and said second latching elements to the respective other one of them.

42. Roller mill as claimed in claim 41, wherein said hinge moving means are connected to all locking means to release all said pivotal connections at once.

43. Roller mill as claimed in claim 41, wherein said locking means are at least approximately equally spaced from each other.

44. Roller mill as claimed in claim 41, wherein said hook means are mounted on said cover means, whereas said latch means are situated within the region of a margin of said opening.

45. Roller mill as claimed in claim 41, wherein said hinge moving means are connected to said latch means, said hook means being stationary.

46. Roller mill as claimed in claim 41, wherein said hook means is T-shaped so as to form a double hook, whereas said latch means comprises a flat strip having T-shaped insertion openings for inserting and holding said double hook.

47. Roller mill as claimed in claim 41, wherein said hinge moving means comprises a single actuating element.

48. Roller mill as claimed in claim 47, wherein said actuating element comprises an actuating shaft extending between said pair of first latching elements and being movable into at least two different positions;

first and second crank portions on said shaft oriented in opposite directions and being connected each to one of said pair of first latching means;

notch means connected to said actuating shaft means for defining at least one of said positions; and a handle fixed to said shaft for enabling manual actuation of said first latching elements.

49. Roller mill as claimed in claim 41, wherein said hinge moving means comprises a single actuating element operatively connected to said first latching element.

50. A roller mill comprising:

frame means;

at least one pair of rollers on said frame means, each roller having two ends being rotatable about an axis of rotation, the axis being situated in a substantially horizontal plane;

a pair of fixed bearing housings supported by said frame means, said bearing housings being spaced to receive the respective ends of one of said pair of rollers;

a pair of movable bearing housings on said frame to receive the respective ends of the other one of said pair of rollers;

gap setting means interconnected between said fixed and said movable bearings for setting a desired gap between said pair of rollers, there being separating forces acting on the rollers in each pair of said rollers in operation of the mill; and wherein said gap setting means comprises adjustable loading means operative between said fixed bearing housings and said movable bearing housings to contain the separating forces acting on said at least one roller pair in operation of the mill, independently from said frame means, said adjustable loading means enabling a quick increase of said gap in case a foreign object enters the gap;

abutment means being displaceable towards and away from said bearing housings for a fine adjustment of said gap, said abutment means being free of any self-locking action;

displacement drive means for said abutment means;

rod means interconnecting said abutment means with at least one of said movable bearing housings for transferring displacement of said abutment means for fine adjustment to said movable bearing housing; and wherein said adjustable loading means, for a quick increase of the gap, is also connected to said displaceable abutment means.

51. Roller mill as claimed in claim 50, wherein said adjustable loading means is connected to said displaceable abutment means through said rod means.

52. Roller mill as claimed in claim 50, wherein said displaceable abutment means comprises an eccentric rotatable about an axis.

53. Roller mill as claimed in claim 52 further comprising lever means having a first end and a second end for interconnecting said displacement drive means and said eccentric for rotating the same about its axis.

54. Roller mill as claimed in claim 53, wherein the first end of said lever means is pivoted about said eccentric, said displacement drive means displacing said lever in a direction across a plane parallel to said horizontal plane.

55. Roller mill as claimed in claim 54, wherein said displacement drive means comprises a rotatable spindle extending across said horizontal plane and having a thread; and nut means on said spindle for engagement with said thread to be displaced upon rotation of said spindle in a direction across a plane parallel to said horizontal plane; and a pivot axle on said nut means, said pivot axle being connected to said second end of said lever means.

56. Roller mill as claimed in claim 55, wherein said spindle is axially supported by one of said fixed bearing housings.

57. Roller means as claimed in claim 56, wherein said fixed bearing housings comprise pivot axles for pivotal connection with said movable bearing housings, said spindle being axially supported by one of said pivot axles.

* * * * *